US010240906B2

(12) United States Patent
Cury et al.

(10) Patent No.: US 10,240,906 B2
(45) Date of Patent: Mar. 26, 2019

(54) PENETRATOR INCORPORATING A CORE ENCLOSED IN A DUCTILE SHEATH AND MANUFACTURING PROCESS FOR SUCH A PENETRATOR

(71) Applicants: CIME BOCUZE, Saint Pierre en Faucigny (FR); NEXTER MUNITIONS, Versailles (FR)

(72) Inventors: Rafael Cury, Annemasse (FR); Laurent Dartus, Scionzier (FR); Fabien Issartel, Marignier (FR); Hervé Couque, Bourges (FR); Nicolas Eches, Bourges (FR)

(73) Assignees: CIME BOCUZE, Saint Pierre en Faucigny (FR); NEXTER MUNITIONS, Versailles (FR)

( * ) Notice: Subject to any disclaimer, the term of this patent is extended or adjusted under 35 U.S.C. 154(b) by 0 days.

(21) Appl. No.: 15/737,899

(22) PCT Filed: Jul. 20, 2016

(86) PCT No.: PCT/FR2016/000122
§ 371 (c)(1),
(2) Date: Dec. 19, 2017

(87) PCT Pub. No.: WO2017/013314
PCT Pub. Date: Jan. 26, 2017

(65) Prior Publication Data

US 2018/0231358 A1 Aug. 16, 2018

(30) Foreign Application Priority Data

Jul. 22, 2015 (FR) ..... 15 01552

(51) Int. Cl.
*F42B 12/06* (2006.01)
*B22F 7/06* (2006.01)
(Continued)

(52) U.S. Cl.
CPC ..... *F42B 12/06* (2013.01); *B22F 7/062* (2013.01); *C22C 1/045* (2013.01); *F42B 14/06* (2013.01); *F42B 14/061* (2013.01)

(58) Field of Classification Search
CPC ..... F42B 12/72; F42B 12/74; F42B 12/78
(Continued)

(56) References Cited

U.S. PATENT DOCUMENTS 8,580,188 B2 11/2013 Taal et al.
2014/0260808 A1* 9/2014 Sweetman ..... B22F 7/062 76/108.1

FOREIGN PATENT DOCUMENTS

EP 1940574 B1 6/2012
FR 2521717 A1 8/1983
(Continued)

OTHER PUBLICATIONS

Oct. 13, 2016 International Search Report issued in International Patent Application No. PCT/FR2016/000122.

*Primary Examiner* — J. Woodrow Eldred
(74) *Attorney, Agent, or Firm* — Oliff PLC

(57) ABSTRACT

A heavy metal penetrator with a high tungsten content incorporating a central part or core formed of an alloy comprising from 85% to 97% in mass of tungsten associated with additional metals and which is enclosed by a peripheral sheath made of a more ductile tungsten alloy than that of the core. The sheath of the penetrator is made of an alloy comprising 30% to 72% in mass of tungsten, the core comprising nodules of tungsten bound in a matrix of a gamma phase $\gamma_C$ associating tungsten with additional metals, the two gamma phases being continuously joined to one another with no transition zone.

6 Claims, 3 Drawing Sheets

Figure 1:
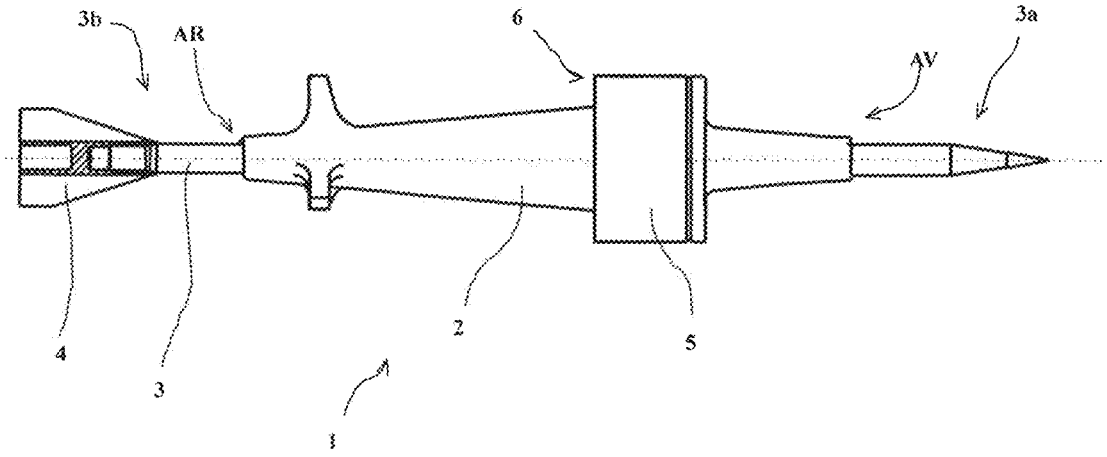

(51) Int. Cl.
*C22C 1/04* (2006.01)
*F42B 14/06* (2006.01)

(58) Field of Classification Search
USPC ..... 102/514
See application file for complete search history.

(56) References Cited

FOREIGN PATENT DOCUMENTS

| | | | |
|---|---|---|---|
| FR | 2661739 | A1 | 11/1991 |
| WO | 03/027340 | A1 | 4/2003 |

* cited by examiner

PENETRATOR INCORPORATING A CORE ENCLOSED IN A DUCTILE SHEATH AND MANUFACTURING PROCESS FOR SUCH A PENETRATOR

The technical scope of the invention is that of heavy metal penetrators and in particular of penetrators used to produce sub-calibre projectiles of large calibre (calibre greater than or equal to 25 mm).

These projectiles are more often called arrow kinetic projectiles. They incorporate a sub-calibre penetrator or rod that is fired by a weapon using a sabot of the same calibre as the weapon.

For a 120 mm calibre projectile, the penetrator is generally of a diameter of 20 to 30 mm and the sabot enabling it to be fired is formed of an assembly of segments of a light material (aluminium alloy, for example).

Patents FR-2521717 and FR-2661739 disclose examples of such arrow projectiles.

To enhance the penetrating effectiveness of arrow projectiles, the penetrators are usually made of an alloy having a high tungsten content.

Such alloys are sensitive to the transversal stresses to which they are subjected during their impact on an inclined target or else during their interaction with reactive protection. Transversal shocks cause the penetrator to fracture thereby reducing the piercing power of the penetrator after the passage of such targets.

It is known to provide the penetrators with a peripheral sleeve of a more ductile material to give the penetrator greater flexural strength.

For example, patent EP-1940574 discloses a penetrator incorporating a core formed of an alloy comprising between 90 to 97% in mass of tungsten which is enclosed in a peripheral sheath of a tungsten alloy that is more ductile than the material of the core.

The sheath of this penetrator comprises a proportion of tungsten of between 85% and 91%.

The percentage in tungsten of the sheath is relatively close to that of the core and this penetrator therefore has insufficient flexural strength.

Such a penetrator is not adapted to present day manufacturing requirements for kinetic projectiles of substantial elongation, which is to say those penetrators with a high ratio (L/D) of length (L) to diameter (D).

Today, penetrators having an elongation of over 20 (L/D>20) are being made. This means penetrators are produced that are more than 500 mm long for a diameter of 25 to 30 mm. Such penetrators are particularly sensitive to impacts on inclined targets.

It is not easy, however, to give the sheath greater ductility than the core. Furthermore, it is also necessary to ensure a connection between the material of the core and that of the sheath. If this connection is insufficient, the radial or longitudinal loads lead these elements to separate during impact or even as a consequence of firing.

To ensure the connection, patent EP-1940574 proposes to sinter the core and the sheath in the same mould. The separation between the sheath and core is ensured by a specific funnel associated with a tube that separates the core zone from the sheath zone. After the materials of the core and sheath have been put in place, the tube and funnel are removed. The materials of the sheath and core are thus in contact with one another and the sintering can be performed.

Such a process suffers the drawback of leaving a transition zone between the sheath and cote of a thickness of between 25 micrometers and 200 micrometers. This zone is formed of a material whose composition and characteristics are between those of the core and the sheath. Such a transition zone associates, as for the core and the sheath, nodules of tungsten and a gamma phase. The size of the tungsten nodules and the composition of the gamma phase of this zone are obligatorily different from those of the core and the sheath. Were this is not the case, there would be no such transition zone.

The drawback to such a transition zone lies in that it constitutes an interface that weakens the rod thus made.

Even more specifically, the geometry of this transition zone (thickness, positioning with respect to the penetrator axis) is not controlled.

This results in variations in the radial positioning of this transition zone along the penetrator, variations all the greater in an elongated penetrator. This also results in a variation in the strength of this interface along the penetrator, thereby reducing the piercing performances, Furthermore, the process disclosed by patent EP-1940574 imposes a proportion of tungsten in the sheath that is relatively close to that of the tungsten in the core.

The ductility of the sheath obtained using this process is thus little more than that of the core, at around 5 to 10%.

The invention thus aims to propose a penetrator structure offering an excellent adherence between the core and sheath, even where there is a difference in the proportion of tungsten in the core and sheath.

The penetrator according to the invention is thus able to have a sheath ductility that is greater than that of known penetrators with tungsten sheaths.

Thus, the invention relates to a heavy metal penetrator with a high tungsten content incorporating a central part or core formed of an alloy comprising from 85% to 97% in mass of tungsten associated with additional metals and which is enclosed by a peripheral sheath made of a more ductile tungsten alloy than that of the core, penetrator wherein the sheath is made of an alloy comprising 30% to 72% in mass of tungsten, the core comprising nodules of tungsten bound in a matrix of a gamma phase $\gamma_C$ associating tungsten with additional metals, the two gamma phases being continuously joined to one another with no transition zone.

Advantageously, the gamma phases of the core $\gamma_C$ and the sheath $\gamma_G$ will be of a composition associating tungsten, nickel, cobalt and possibly iron.

According to one embodiment, the core may comprise 85% in mass of tungsten and the sheath 38% in mass of tungsten, the gamma phases of the core $\gamma_C$ and the sheath $\gamma_G$ being compositions associating tungsten, nickel and cobalt.

According to another embodiment, the core may comprise 89% in mass of tungsten and the sheath 68% in mass of tungsten, the gamma phases of the core $\gamma_C$ and the sheath $\gamma_G$ having compositions associating tungsten, nickel and cobalt.

According to yet another embodiment, the core alloy may comprise 95% in mass of tungsten, 2% in mass of nickel, 1.5% in mass of cobalt and 2% in mass of Fe and the sheath 70% in mass of tungsten, the gamma phases of the core $\gamma_C$ and the sheath $\gamma_G$ having compositions associating tungsten, nickel, cobalt and iron.

The invention also relates to a process to manufacture such a penetrator.

This manufacturing process for a heavy metal penetrator with a high tungsten content is characterised in that it comprises the following steps (which lead to the production of a blank penetrator):

production of a core composed of compressed powders comprising from 85% to 97% in mass of tungsten associated with additional material comprising nickel, cobalt with or without iron, production of a sheath composed of compressed powders comprising from 30% to 72% in mass of tungsten associated with additional metals comprising nickel, cobalt with or without iron, assembly by sintering of the sheath and core.

Figure 2:
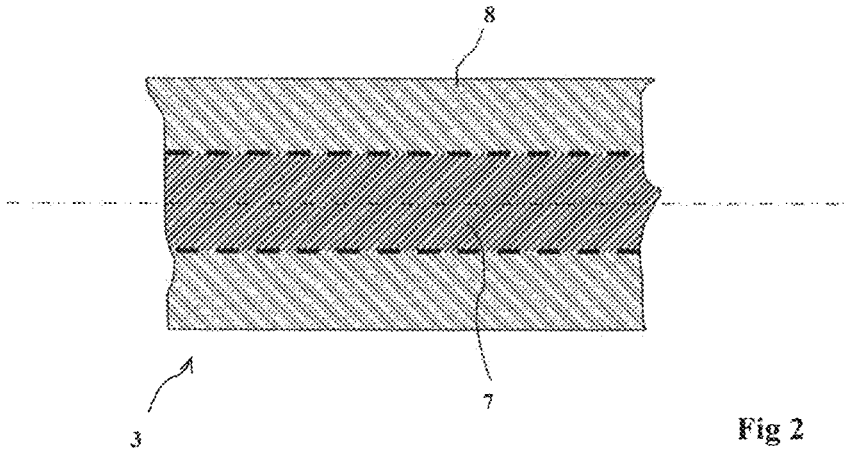
Figure 3:
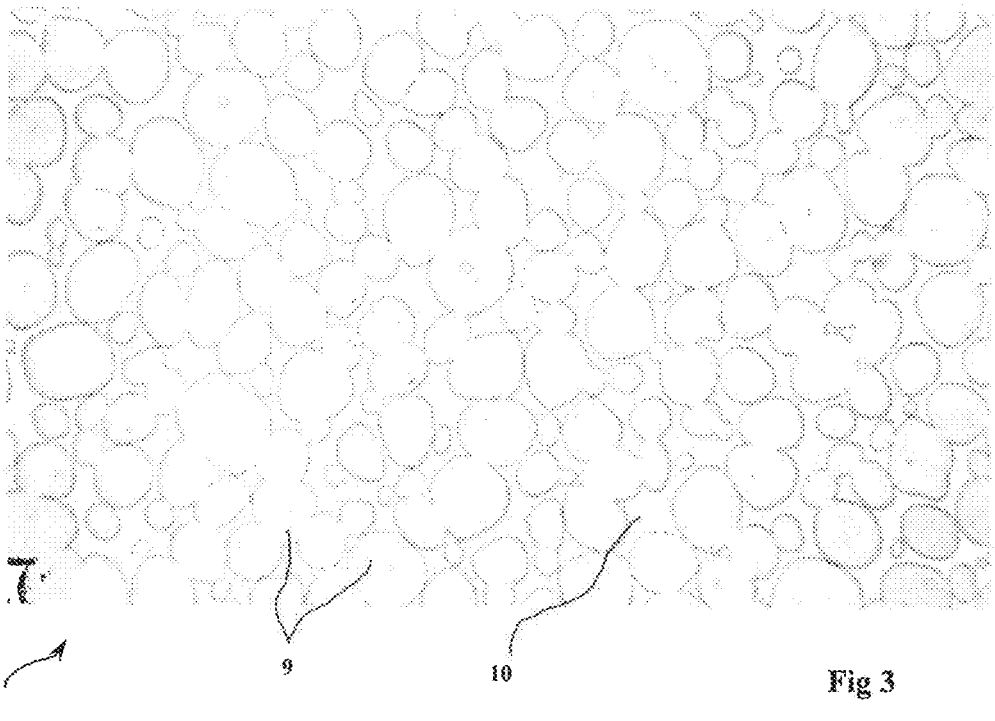
Figure 4:
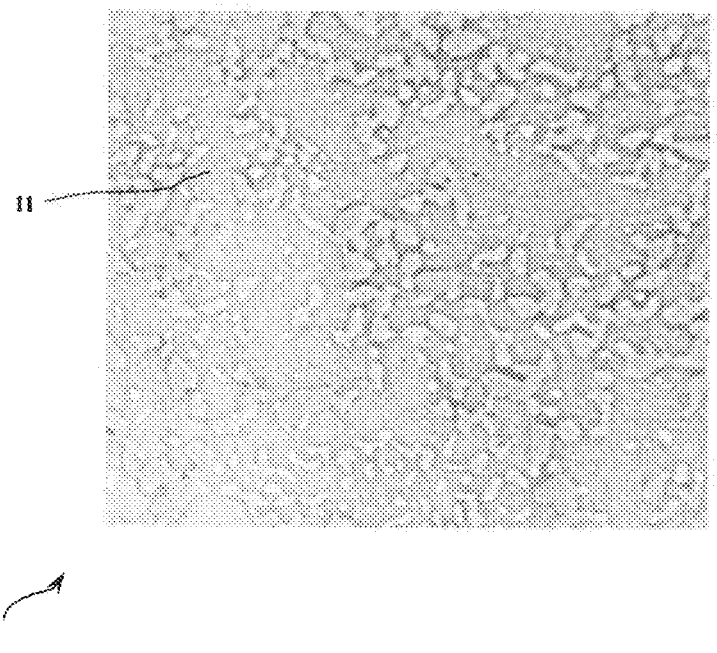
Figure 5A:
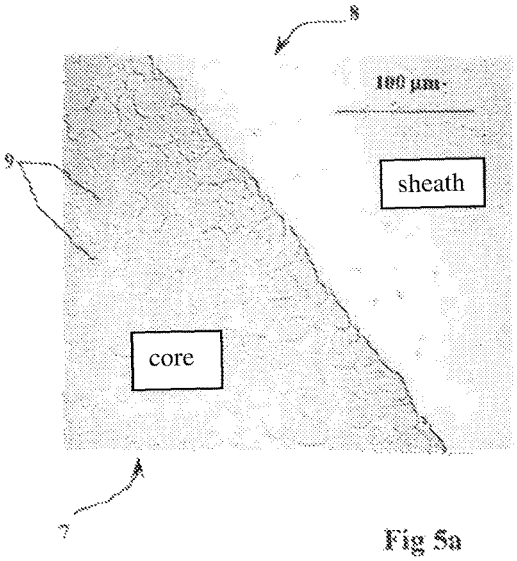
Figure 5B:
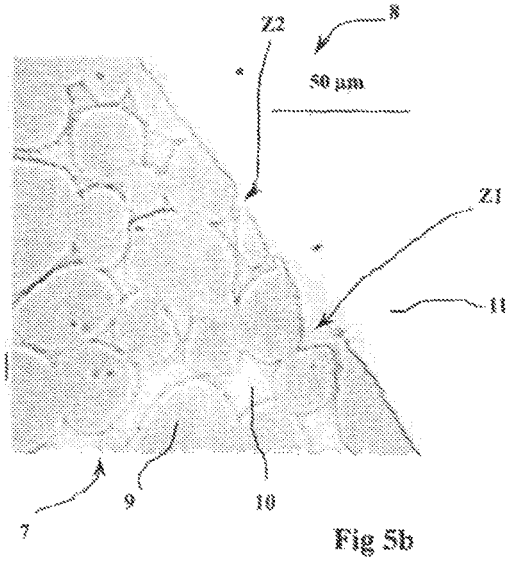

The invention will become more apparent from the additional description made hereafter of the different embodiments, such description being made with reference to the appended drawings, in which:

FIG. 1 shows the general architecture of a sub-calibre projectile of the arrow energy type, FIG. 2 shows a partial longitudinal section view of a penetrator according to the invention, FIG. 3 is a micrography showing the structure of the core of the penetrator according to the invention, FIG. 4 is a micrography showing the structure of the sheath of the penetrator according to the invention, FIG. 5*a* is a micrography showing the link between the sheath and core, and FIG. 5*b* is an enlargement of the micrography shown in FIG. 5*a*.

FIG. 1 shows a kinetic energy projectile 1 classically equipped with a sabot 2 made of a light material (such as aluminium alloy), such sabot formed from several segments surrounding a sub-calibre penetrator 3.

The penetrator incorporates a tapered fore part 3*a* and at its rear part 3*b* carries tail fins 4 to ensure stabilisation during its trajectory. The structure of the penetrator 3 itself will be described hereafter.

The sabot is fitted with a band 5, made of a plastic material, to ensure gas tightness for the propellant gases produced during firing in the gun barrel (not shown).

During firing, the gases from the propellant charge (not shown) exert their pressure on a rear part 6 of the full calibre sabot and which forms what is known as the thrust plate.

Such an overall configuration for a fin-stabilised sub-calibre projectile (kinetic energy projectile) is well known. Patents FR-2521717 and FR-2661739 describing known kinetic energy projectiles may thus be consulted.

The sabot 2 is intended to enable the projectile to be fired by the weapon, It is formed of several segments (three as a general rule) which surround the penetrator 3 and are in contact two-by-two along the joint planes.

Upon exiting the gun barrel, the sabot segments spread out from the penetrator 3 under the action of the aerodynamic pressure exerted on the fore part (AV) of the sabot 2.

This spreading of the segments causes the band 5 to rupture thereby allowing the sabot to release the penetrator 3 which continues its trajectory.

Form-fitting means (not shown), for example threading, are positioned between the sabot 2 and the penetrator 3 to ensure the driving of the latter.

FIG. 2 shows in greater detail the structure of the penetrator 3, which incorporates a central part or core 7 enclosed in a peripheral sheath 8.

In accordance with the invention, the core is formed of an alloy comprising from 85% to 97% in mass of tungsten and the sheath is made of an alloy comprising from 30% to 72% in mass of tungsten.

The tungsten is alloyed, both for the core and the sheath, with addition metals such as nickel, which will always be associated with cobalt, with or without iron.

More precisely and with reference to FIG. 3, in the core 7, the material comprises nodules 9 of $\alpha$ phase centred cubic crystalline structure tungsten that are bound in a matrix 10 of a gamma $\gamma_C$ phase associating tungsten, nickel and cobalt, with or without iron (Fe), with a face centred cubic crystalline structure.

The proportion of tungsten in the core is of between 85% and 97%, leading to a core density of around 17 g/cm$^3$. The core 7 is formulated so as to have an upper yield point of greater than or equal to 1100 MPa (Mega Pascals). The ductility is of around 6% and its Charpy strength (un-notched test according to standard ISO 179-1) is of around 80 J/cm$^2$.

The core composition will incorporate (proportions in mass):

85 to 97% of tungsten, 1 to 10% of nickel, 1 to 6% of cobalt.

According to another embodiment, the composition of the core will incorporate (proportions in mass):

8 to 97% of tungsten, 1 to 10% of nickel, 0.5 to 10% of iron, 1 to 8% of cobalt.

With reference to FIG. 4, in the sheath 8, the material essentially comprises a matrix 11 of a gamma $\gamma_G$ phase essentially associating tungsten with nickel and cobalt, with or without iron, and with a face centred cubic crystalline structure, which is the sign this sheath is of high strength.

The percentage of tungsten in the sheath 8 is of between 30% and 72%, thereby giving this sheath a density that can vary between 10 g/cm$^3$ and 15 g/cm$^3$. The alloy of the sheath 8 will be formulated so as to present a ductility of over 7% and high strength: Charpy strength (un-notched test according to standard ISO 179-1) greater than or equal to 200 J/cm$^2$.

The composition of the sheath will incorporate (proportions in mass):

30 to 72% of tungsten, 20 to 44% of nickel, 5 to 25% of cobalt.

According to another embodiment, the composition of the sheath will incorporate (proportions in mass):

30 to 72% of tungsten, 30 to 44% of nickel, 0.5 to 10% of iron, 5 to 25% of cobalt.

Given the difference in concentration of the tungsten in the sheath and the core, the sheath 8 is therefore much more ductile than the core 7.

If the gamma $\gamma_C$ phase of the core associates tungsten with nickel and cobalt (with or without iron.), the gamma $\gamma_G$ phase of the sheath will also incorporate nickel and cobalt (with or without iron) as additional metals.

FIGS. 5*a* and 5*b* show that after the penetrator 3 has been shaped, the matrices 10 and 11 of the sheath 7 (matrices formed by the gamma phases of the core and the sheath) will be joined together continuously with no transition zone. Reference may be made, in particular, to the zones marked by arrows Z1 and Z2 (FIG. 5*b* is a double enlargement of that in FIG. 5*a*). FIGS. 5*a* and 5*b* clearly show that the gamma phases of the core and sheath penetrate one another and thus, with this invention, there is no transition phase such as described in patent EP-1940574.

This results in a tight bond of the sheath 8 on the core 7 and the extremely high strength of this bond.

To produce such a penetrator 3 a process is implemented such as that described hereafter:

During a step A, in order to manufacture an alloy comprising 85% to 97% in mass of tungsten, tungsten, nickel, cobalt and possibly iron powders are homogeneously mixed and pre-compressed in the form of a rod that will constitute the core.

During a step B, a sheath 8 is formed of an alloy comprising from 30% to 72% in mass of tungsten associated with additional metals comprising nickel, cobalt and possibly iron.

The materials are homogenous mixed are then compressed in tooling that incorporates a cylindrical core with a diameter that is equal to or greater than the internal diameter required for the sheath. The rest of the compression tooling is classical.

During a step C, the sheath and core are sintered together.

The sintering takes place in the presence of a liquid phase. The high-power sintering process using induction heating and disclosed by patent application WO03/027340 may be implemented.

The alloys are consolidated at temperatures of between 1400° C. and 1600° C.

Sintering enables gamma phase continuity between the sheath and the core to be ensured.

These steps A to C thus permit the manufacture of a blank penetrator.

Thereafter, this semi-finished penetrator is machined to obtain the required penetrator 3. In particular, the external threading will be made on the sheath enabling the penetrator 3 to be fitted with its launching sabot 2.

Sheaths of a diameter of between 1.4 and 2.0 times that of the diameter of the core may be produced. The thickness of the sheath 8 may thus vary between 5 mm and 9 mm for a penetrator with an external diameter of 35 mm.

By way of example, the following penetrators have been produced:

EXAMPLE 1

Diameter of the core equal to 0.5-0.7 times the diameter of the sheath.

The core is formed of 85% in mass of tungsten, with a density of 16.5 g/cm$^3$, a yield point of 1,800 MPa, a ductility of 10% and an un-notched Charpy strength of 150 J/cm$^2$.

The alloy of the core comprises 85% in mass of tungsten, 15% in mass of nickel and 5% in mass of cobalt.

The sheath has a density of 11.2 g/cm$^3$, a yield point of 1,400 MPa, a ductility of 18% and an un-notched Charpy strength of 400 J/cm$^2$. The alloy of the sheath comprises (proportions in mass): 38.0% of tungsten, 40% of nickel and 22% of cobalt.

This penetrator (and its blank) was produced by implementing the process described above.

EXAMPLE 2

Diameter of the core equal to 0.5-0.7 times the diameter of the sheath.

The core is formed of 89% in mass of tungsten, with a density of 17.1 g/cm$^3$, a yield point of 1,500 MPa, a ductility of 9% and an un-notched Charpy strength of 300 J/cm$^2$.

The alloy of the core comprises 89% in mass of tungsten, 7.5% in mass of nickel and 3.5% in mass of cobalt.

The sheath is formed of 68% in mass of tungsten and has a density of 14.1 g/cm$^3$, a yield point of 2,000 MPa, a ductility of 11% and an un-notched Charpy strength of 400 J/cm$^2$. The alloy of the sheath comprises (proportions in mass): 68% of tungsten, 22% of nickel and 10% of cobalt.

This penetrator (and its blank) was produced by implementing the process described above.

EXAMPLE 3

Diameter of the core equal to 0.5-0.7 times the diameter of the sheath.

The core is formed of 95% in mass of tungsten, with a density of 18.3 g/cm$^3$, a yield point of 1,300 MPa, a ductility of 7% and an un-notched Charpy strength of 50 J/cm$^2$. The alloy of the core comprises 95% in mass of tungsten, 2% in mass of nickel and 1.5% in mass of cobalt and 2% in mass of iron.

The sheath is formed of 70.0% in mass of tungsten and has a density of 14.0 g/cm$^3$, a yield point of 2,000 MPa, a ductility of 9% and an un-notched Charpy strength of 300 J/cm$^2$. The alloy of the sheath comprises (proportions in mass): 70.0% of tungsten, 18% of nickel and 10% of cobalt and 2% in mass of iron.

This penetrator (and its blank) was produced by implementing the process described above.

The invention claimed is:

1. A heavy metal penetrator with a high tungsten content incorporating a central core formed of an alloy comprising from 85% to 97% in mass of tungsten associated with additional metals and which is enclosed by a peripheral sheath made of a more ductile tungsten alloy than that of the core, wherein the sheath comprises a gamma phase $\gamma_G$ and is made of an alloy comprising 30% to 72% in mass of tungsten, the core comprises nodules of tungsten bound in a matrix of a gamma phase $\gamma_C$ associating tungsten with additional metals, and the two gamma phases are continuously joined to one another with no transition zone.

2. A heavy metal penetrator according to claim 1, wherein the gamma phases of the core $\gamma_C$ and of the sheath $\gamma_G$ have a composition associating tungsten, nickel, cobalt and possibly iron.

3. A heavy metal penetrator according to claim 2, wherein the core comprises 85% in mass of tungsten and the sheath 38% in mass of tungsten, the gamma phases of the core $\gamma_C$ and the sheath $\gamma_G$ being of compositions associating tungsten, nickel and cobalt.

4. A heavy metal penetrator according to claim 2, wherein the core comprises 89% in mass of tungsten and the sheath 68% in mass of tungsten, the gamma phases of the core $\gamma_C$ and the sheath $\gamma_G$ having compositions associating tungsten, nickel and cobalt.

5. A heavy metal penetrator according to claim 2, wherein the alloy making up the core comprises 95% in mass of tungsten, 2% in mass of nickel, 1.5% in mass of cobalt and 2% in mass of iron and the sheath 70% in mass of tungsten, the gamma phases of the core $\gamma_C$ and the sheath $\gamma_G$ having compositions associating tungsten, nickel, cobalt and iron.

6. A process to manufacture a heavy metal penetrator with a high tungsten content according to claim 1, wherein the method comprises the following steps:

production of a core composed of compressed powders comprising from 85% to 97% in mass of tungsten associated with additional material comprising nickel, cobalt with or without iron; and production of a sheath composed of compressed powders comprising from 30% to 72% in mass of tungsten associated with additional metals comprising nickel, cobalt with or without iron, assembly by sintering of the sheath and core.

* * * * *